US005721083A

United States Patent [19]

Masuda et al.

[11] Patent Number: 5,721,083

[45] Date of Patent: Feb. 24, 1998

[54] DRY COLOR TONER FOR ELECTROPHOTOGRAPHY AND PRODUCTION PROCESS THEREOF

[75] Inventors: Minoru Masuda, Suntoh-gun; Akio Matsui; Masami Tomita, both of Numazu, all of Japan

[73] Assignee: Ricoh Company, Ltd., Tokyo, Japan

[21] Appl. No.: 529,532

[22] Filed: Sep. 18, 1995

[30] Foreign Application Priority Data

Sep. 16, 1994 [JP] Japan ..... 6-248423

[51] Int. Cl.[6] ..... G03G 9/08

[52] U.S. Cl. ..... 430/106; 430/137

[58] Field of Search ..... 430/106, 106.6, 430/137

[56] References Cited

U.S. PATENT DOCUMENTS 5,010,114 4/1991 Liang et al. ..... 521/109.1

5,387,489 2/1995 Fuller et al. ..... 430/137

5,415,964 5/1995 Hayashi et al. ..... 430/106

5,529,871 6/1996 Ichimura et al. ..... 430/137

5,578,407 11/1996 Kasuya et al. ..... 430/137

*Primary Examiner*—John Goodrow

*Attorney, Agent, or Firm*—Oblon, Spivak, McClelland, Maier & Neustadt, P.C.

[57] ABSTRACT

A color toner that is able of forming a projected image having excellent color reproducibility when a toner image is produced on an optically transparent film by electrophotography, and a color toner that is excellent in chargeability and contaminates the developing roller to a minimum extent is provided. A process for producing the toner is also provided, wherein a color toner containing at least a binder resin, a pigment and a charge controller is produced in a first step of preliminarily kneading a blend of the color toner having a haze degree of 1 through 10% and the pigment with an organic solvent at a temperature lower than the melting temperature of the binder resin followed by a second step of thermal melting and kneading with addition of the binder resin and charge controller.

15 Claims, 1 Drawing Sheet

DRY COLOR TONER FOR ELECTROPHOTOGRAPHY AND PRODUCTION PROCESS THEREOF

BACKGROUND OF THE INVENTION

1. Field of the Invention

The present invention relates to a color toner for electrophotography, electrostatic printing and others.

2. Description of the Related Art

The technology of image formation using electrophotography tends to be diversified into various methods, such as using digital data and color. Formation of a full color image using full color electrophotography is done to reproduce the color using a color toner either consisting of three primary colors, yellow, magenta and cyan, or consisting of four colors, the three primary colors and black (hereinafter a toner of the latter four colors is referred to as a color toner). This is one-time fixing reproduction of a full color image on the same substrate by overlapping toners. It is also possible to use a transparent film as the substrate, onto which letters and images are formed by a color toner, and to project the color images by using an overhead projector (OHP).

One problem is the reproducibility or clearness of the colors; that is, projected images tend to have hazy color images rather than clear color images despite the fact that images are formed by electrophotography using a color toner. A conceivable cause of the hazy color images on the projected surface is unevenness of the toner image surface on the OHP film, which makes the projected light scatter or reflect irregularly, with the result that light passing through the toner image portion on the OHP film does not arrive at the surface of the projected surface and, therefore, the toner image portion on the OHP film creates a shadow on the projected surface.

A method proposed to solve this defect is surface treatment of the toner images formed on an OHP film. For example, JP-A 63-123055 proposes formation of a transparent toner film layer on the color toner image after a color toner image is formed on a transparent film. In this way, the surface of the toner image is made smooth to solve the above defect. This method, however, cannot reproduce the color of projected images sufficiently, because the transparent toner film layer shields the light to some degree.

Thus, no effective means for solution of the above-mentioned defect have yet been found.

On the other hand, when a developer in powder form is used in the process of forming images by electrophotography, two-component developers containing toner and carrier and one-component developers containing no carrier are known. The two-component development process using a two-component developer mentioned above has the advantage of comparatively stable and good recorded images, but has disadvantages such as carrier deterioration, changes in the mixed ratio of toner and carrier, complicated maintenance of equipment, rather large size of equipment, and possible loss, over a long period service, of electric charge necessary for development due to adhesion of toner or ash contained in the toner to the surface of the carrier.

The one-component development process (in particular a non-magnetic one-component development process) using a one-component developer is poor in feeding the toner to the development roller and in holding the toner on the development roller. Because of this disadvantage, the toner may be forced to rub on the roller. The amount of toner on the development roller may be controlled by a blade in this process. As the result, filming of colorants and other components on the development roller may occur easily. The filming phenomenon results in a shorter life of the development roller and unstable electric charge on the toner. In the one-component development process, chargeability of the toner is required to be larger than in the two-component development process, and chargeability of colorants in the toner is more important. In a full color process in particular, the balance of toner in three or more overlapped colors is important and chargeability of respective colors should be uniform. In addition, insufficient fixing may occur by filming of colorants and other components on the fixing roller.

Numerous proposals have been made for solving the defects mentioned above in both a one-component developer and a two-component developer. However, no satisfactory solutions have yet been obtained. A need continues to exist for a method of solving the defects of developers as mentioned above, in particular, improvement of clearness of the projected image obtained from the toner image formed on a transparent film.

SUMMARY OF THE INVENTION

The present invention has been made based on the technical background described above. One object of the present invention is to provide a color toner that can clearly reproduce the image color with an OHP projection, in particular, of the toner image formed on a light transmitting film by electrophotography. Another object of the present invention is to provide a color toner that is excellent in chargeability of the toner and minimizes contamination of the toner to the developing roller.

The present inventors have carefully studied the toner particles themselves in terms of the color reproducing mechanism of the projected image, and have confirmed that the transparency of toner particle is strongly correlated with the reproducibility. This finding has led to the present invention.

According to the present invention, a dry color toner for electrophotography is provided comprising at least a binder resin, a pigment and a charge controller as the main components, where the color toner has a haze factor of 1 through 10%.

It has been discovered that an OHP projection image excellently reproduces the color by use of a color toner which has a haze factor within a certain range as specified above. A color toner which has a haze factor exceeding 10% gives insufficient reproducibility of color to the projected image. On the contrary, a color toner having a haze factor less than 1% produces excessively thin color making it difficult to discern the projected image.

The haze factor referred to herein is an index representing transparency of a toner and is generally defined as the percentage ratio of the intensity of transmitted light obtained by integrating all of the light within an angle $\beta>2.5°$ to the intensity of incident light. The haze factor is measured as follows.

A toner in an amount of 1 mg/cm$^2$ is solid-developed on an OHP sheet, which is then allowed to pass through a fixing unit that is a modified device of the fixing unit of a PRETAIL 550, a color copy machine manufactured by Ricoh Co., Ltd, under following conditions.

| | |
|---|---|
| Linear velocity of the fixing unit: | 90 ± 2 (mm/sec) |
| Fixing nip width: | 10 ± 1 (mm) |
| Fixing roller surface temperature: | 160 ± 2 (°C.) |

The above fixed sample is fed to a direct reading haze computer HGM-2DP type made by SUGA SIKENKI KK, and the haze factor is determined. The haze factor of the toner is the haze value after subtraction of the haze factor of the OHP sheet itself. The OHP sheet used in the examples below was TYPE PPC-DX manufactured by Ricoh Co., Ltd. The haze factor of this OHP sheet itself was 7%. All the haze factors described herein are, therefore, expressed as the total haze factor of the sheet combined with the toner minus 7%.

In a process for making the haze factor of a toner 1 to 10%, it is particularly effective to make the particle size of pigment constituting the toner smaller than conventional pigment size. It has been confirmed that the haze factor of a toner is controlled within the range specified above relatively easily by making the average dispersed diameter in the toner not more than 0.2 μm, preferably not more than 0.15 μm.

An electrophotography color toner that has a haze factor of 1 through 10% as proposed in the present invention or an electrophotography color toner containing pigment particles of small particle size as described above is not a known product nor described in any known literature. Known toners cannot attain the objects of the present invention.

DETAILED DESCRIPTION OF THE PREFERRED EMBODIMENTS

Figure 1:
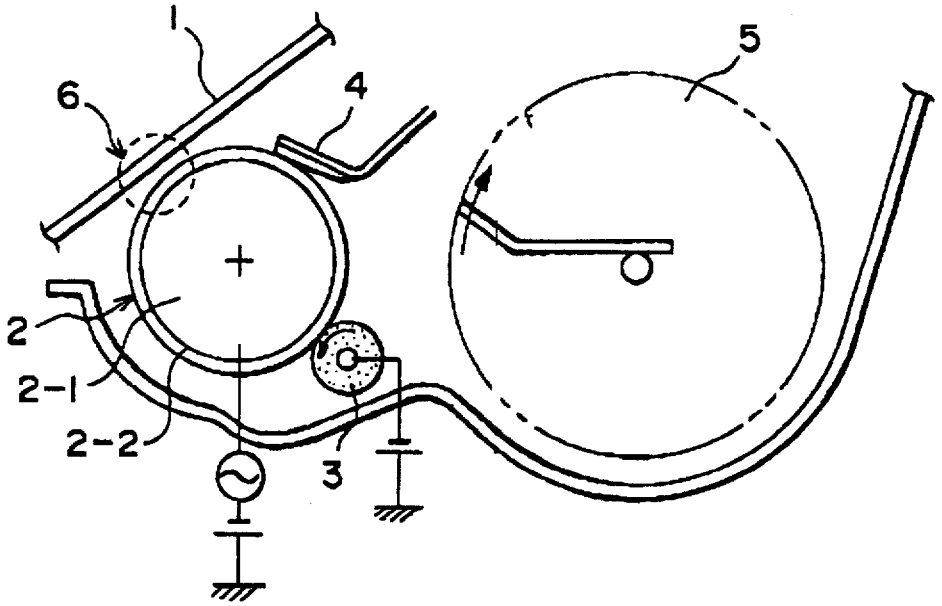
FIG. 1 is a schematic cross-sectional view, mainly showing the developing roller, of an example of a developing device which is convenient for using the toner according to the present invention.

An electrophotography color toner containing pigment particles of small particle size as described above can be produced by a novel method as explained below.

That is, in a first step, a blend of a binder resin is preliminarily kneaded with an organic solvent at a temperature lower than the melting temperature of the binder resin. In a following second step, the binder resin and a charge controller are further added and subjected to thermal melting and kneading; and thereafter, the product is pulverized to obtain a color toner. The first kneading step is effective for decreasing the haze factor of the toner when the kneading is done under conditions wherein 5 to 20 parts by weight of the organic solvent to be added to the kneaded product is used to 100 parts by weight of the (binder resin+pigment).

It is believed that use of organic solvent in this method makes the binder resin and pigment adhere sufficiently enough for effective dispersion in the initial period and that the kneading temperature lower than the melting temperature of the binder resin in the first-step milling in this method makes the viscosity of the kneaded product very high and makes the shearing force strong so that the pigment is dispersed adequately in the binder resin and the dispersed particle size of the pigment is made smaller.

The binder resin, pigment and organic solvent are mixed in a blender, such as SUPER MIXER, for example. Then, the resultant mixture is kneaded by the kneader of a two-roll or three-roll kneader at a temperature lower than the melting temperature of the binder resin to get a sample. As the organic solvent, any common solvent may be used so long as the solubility of the binder resin is satisfactory; in particular, acetone, toluene, and methyl ethyl ketone are preferable from the standpoint of pigment dispersion.

According to this novel production process, the particle size of the pigment contained in the product color toner is made smaller. In addition, uniformity in dispersion of the pigment particles is improved, and the color reproducibility of the OHP projection image is further improved.

In the toner of the present invention, inclusion of a charge controller, such as quaternary ammonium or metal salts in an effective amount, is preferred for making the toner charged appropriately. A preferable charge controller adds a transparent or a whitish color that does not impair color tone of the toner and gives the toner a stable negative or positive charge. The addition of a metal salt, preferably of a salicylic acid derivative, is effective in stabilizing the negative charge of the toner.

Examples of the metal salt of a salicylic acid derivative usable for use in the present invention are compounds represented by the following general formula (I).

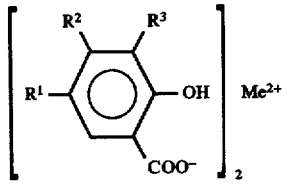

(I)

where $R^1$, $R^2$ and $R^3$ represent, respectively, a hydrogen atom, or an alkyl group or allyl group containing 1 to 10 carbon atoms; preferably hydrogen atoms or an alkyl group or allyl group containing 1 through 6 carbon atoms, where $R^1$, $R^2$ and $R^3$ may be the same or different. Me represents a metal selected from the group zinc, nickel, cobalt, and chromium.

The metal salts of salicylic acid derivative mentioned above may be easily synthesized by the method described in Clark, J. L., Kao, H. (1948), J. Amer. Chem. Soc., 70:2151. For example, a zinc salt may be obtained by adding and mixing 2 mols of sodium salicylate (or sodium salt of the salicylic acid derivative) and 1 mol of zinc chloride to a solvent, and stirring the mixture while warming.

This metal salt is a crystal developing white color and does not develop color when dispersed in the toner binder. Other metal salts than the zinc salt may be prepared in similar ways.

Table 1 shows examples of particularly preferable compounds among the metal salts of salicylic acid derivatives described above.

TABLE 1

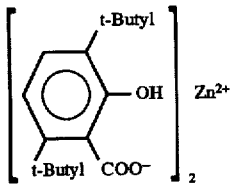

(1)

TABLE 1-continued (2)

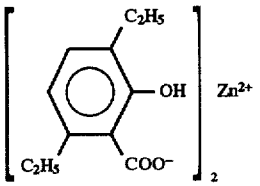

(3)

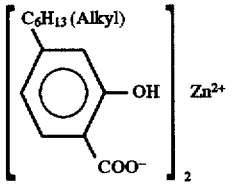

(4)

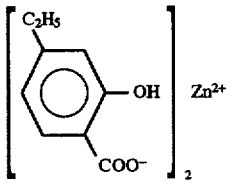

(5)

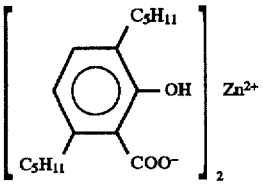

(6)

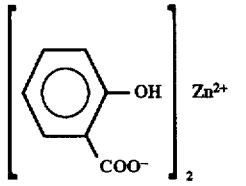

(7)

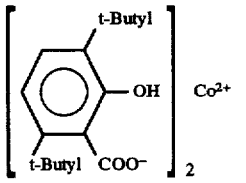

(8)

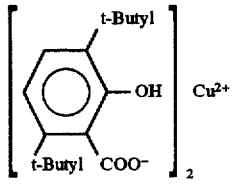

The metal salts of salicylic acid derivatives mentioned above are excellent in dispersibility in binder resins, and minimize film formation (filming) on the developing roller. In particular, a preferable content of the metal salt of the salicylic acid derivatives is 0.5 through 8% by weight.

Furthermore, the presence of silica fine powder that has not less than a 50% degree of hydrophobicity as an external additive on the toner surface is preferred in the toner of the present invention. The electrostatic charge and coating amount of the toner on the developing roller are stabilized even during long periods of use; the development of toner from the developing roller to the latent image carrier is also improved, and the fluctuation of the electrostatic charge of the toner on the developing roller depending on the environmental conditions is decreased.

The amount of the silica fine powder to be added is preferably 0.1 through 2.0% by weight, more preferably 0.5 through 1.0% by weight.

The "degree of hydrophobicity" of the silica fine powder mentioned above can be measured by the following method. Fifty milliliters (ml) of water is added to a 200 ml-beaker, then 0.2 g of silica fine powder is added. Under mild agitation by a magnetic stirrer, methanol is added from a burette of which the chip end is immersed in water when dripping. The volume (unit: ml) of dripping methanol is observed from the beginning of sinking of the floated silica fine powder until complete sinking. The degree of hydrophobicity is calculated by the formula:

Degree of hydrophobicity=[(ml of dripped methanol)/{50+(ml of dripped methanol)}]×100 (%)

The methanol serves as a surfactant. The floating silica fine powder is dispersed into water through the dripping methanol. The higher the degree of hydrophobicity value is, the higher is the degree of hydrophobicity of the silica fine powder. The degree of hydrophobicity of the silica fine powder can be controlled by treating the surface of a silica fine powder with a silane compound or other known hydrophobic treatment. That is, a silane compound is allowed to react with hydroxy groups that are combined with the silica fine particle to replace the hydroxy groups with siloxyl or other groups. Thus, the degree of hydrophobicity is the ratio of the hydroxy groups disappearing by the reaction mentioned above to the hydroxy groups that existed before the hydrophobic treatment. The hydrophobic treatment is done by reacting silica fine powder at an elevated temperature with a silane, trialkylhalogenated silane, hexaalkyl disilazane, or alkylhalogenated silane.

The pigment used in the toner of the present invention may be any known conventional pigment, however, C.I. Pigment Yellow 180 is preferably used as the pigment for a yellow toner. C.I. Pigment Yellow 180 is strongly cohesive. In particular, strong cohesion of this pigment cannot be released in an ordinary toner production process, wherein a resin, pigment and charge controller are melted and kneaded in a roll mill. A resultant toner has a large dispersion diameter of the pigment particles, and thus yields a large haze factor giving poor reproducibility of color, which is required for a color toner. However, according to the process of the present invention, in which kneading is made after preliminary blending of an organic solvent with a binder resin and pigment and the kneading by a roll is made separately in a first step and a second step, the cohesive pigment particles are unbound sufficiently to get a toner with a low haze factor. The amount of pigment is not particularly limited and can be any amount of pigment which is necessary to give the desired color on the printed paper or transparency. One having ordinary skill in this art can readily determine the desired amount of pigment for a particular application by routinely varying the amount of pigment in the toner.

Use of this pigment, even after a long period of service, has proved that pigment peeling from the toner surface is eliminated and that contamination of the carrier surface developed by a two-component developer and filming to the developing roller is prevented. Furthermore, filming to the fixing roller is also prevented.

The color toner according to the present invention is usable not only for OHP, but also for generating a color image on a conventional paper; a clear image is obtained with excellent color reproduction. Furthermore, the technology of the present invention is applicable to both one-component and two-component toners.

Now, the present invention is illustrated in more details by way of examples; however, the present invention is not limited to these. Hereunder "parts" means "parts by weight" in all the cases.

Measurements of characteristics were made as follows.

(1) Electrostatic charge of toner on developing roller

The electrostatic charge of the toner on a developing roller was measured as follows. The toner adhered on the developing roller is suctioned through a Faraday gauge having a filter layer at the exit, and the weight and charge trapped in the Faraday gauge was determined.

The electrostatic charge of the toner on the developing roller is preferably −5 through −30 (μC/g), most preferably −10 through −20 (μC/g) considering sufficient development and quality, including fog of the substrate surface and stability with elapse of time.

(2) Average dispersed pigment diameter of toner

An extremely thin slice of the toner was prepared, and a cross-sectional photograph (magnification: 20,000×) was taken using a transmission electron microscope (H-9000H manufactured by Hitachi).

From this photograph, the average dispersed pigment diameter in the toner was determined as follows. The dispersed diameter of one particle is the average of the longest and shortest dimensions. For those in a cohesion condition, the cohesive body itself is regarded as one particle. The average dispersed diameter was the average dispersed diameter of 50 particles selected at random.

EXAMPLE 1

| | |
|---|---|
| Binder resin (polyester resin: main components are bisphenol A and terephthalic acid, softening point 100° C.): | 100 parts |
| Charge controller (a quaternary ammonium salt containing fluorine): | 3 parts |
| Colorant (azo yellow pigment: C.I. Pigment Yellow 180): | 4 parts |

were blended sufficiently by a blender. The blend was charged into a two-roll mill heated at 100°–110° C., and melted and kneaded for 75 minutes. The kneaded product was allowed to cool naturally. Thereafter, the product was roughly crushed in a cutter mill, further crushed in a fine grinder using jet air, and subjected to an air classifier. Thus, yellow colored host particles of a volume average diameter of 7.6 μm were obtained.

Furthermore, 0.5 parts of titanium oxide fine powder that was subjected to a surface treatment with a titanate coupling agent and had a 45% degree of hydrophobicity was blended with 100 parts of the yellow colored host particles mentioned above in a Henshel mixer; whereby, a yellow toner was obtained. The haze factor, which represents a transparency characteristic of the toner, was 10%. While the haze factor of the toner image on an OHP was 17%, the haze factor of the toner was determined to be 10% since the haze factor of the film itself was 7%. The average dispersion diameter of the yellow pigment was 0.25 μm.

This toner was set in a developing device as shown in FIG. 1, where the developing roller had a silicone resin as the main component of the surface layer, a toner feed roller comprising polyurethane material was contacted with the developing roller, and a blade comprising a polyurethane material was contacted with the developing roller as shown.

In FIG. 1, reference numeral 1 designates a latent image carrier (photosensitive belt), 2: developing roller, 2-1: roller core metal, 2-2: resin coat layer, 3: toner feeder member, 4: developer coating blade, 5: agitator, and 6: developing zone.

The developing device mentioned above was fixed to a machine that was modified from a laser printer manufactured by Ricoh Co., Ltd. and had an organic photosensitive material in the form of a belt as a latent image carrier. The linear velocity ratio of the developing roller to the latent image carrier was set to 1:2. Using this unit, evaluations were made.

Using the toner obtained in this Example, a toner image was transferred to copy paper by the modified Ricoh laser printer provided with the developing device, and fixation was made to a heat roller of the silicone oil-coated type. A clear yellow image resulted. The toner image was transferred onto an OHP sheet and the heat roller fixation was made similarly; an OHP projection was made therefrom and yellow color projection image resulted. The image after printing 30,000 sheets did not change from the image at the initial stage.

EXAMPLE 2

| | |
|---|---|
| Binder resin (polyester resin: same as Example 1): | 70 parts |
| Colorant (copper-Phthalocyanine Blue pigment); | 30 parts |

were blended sufficiently by a blender. The blend was charged into a three-roll mill heated to 100°–110° C., and melted and kneaded for 15 minutes. The kneaded product was removed. Then, the same kneading was repeated two times. The kneaded product was allowed to cool naturally and roughly crushed thereafter by a cutter mill to get a sample of 1 through 3 mm size. This sample is referred to as "Sample 1". Furthermore:

| | |
|---|---|
| Binder resin (the polyester resin: same as mentioned above): | 100 parts |
| Sample | 7 parts |
| charge controller (a quaternary ammonium salt containing fluorine): | 2 parts |

were blended sufficiently by a blender and subjected to the same treatment as Example 1. Thereby, host colored particles of cyan color having a volume average particle diameter of 7.8 μm were obtained. Then, titanium oxide fine powder of Example 1 was added to form a cyan color toner.

The haze factor of this toner was 6% and average dispersion diameter of the pigment in this toner was 0.24 μm.

The OHP projection image was of cyan color.

EXAMPLE 3

| | |
|---|---|
| Binder resin (polyol resin, softening point 110° C.): | 80 parts |
| Colorant (quinacridone magenta pigment): | 20 parts |

were blended sufficiently by a blender. The blend was charged into a three-roll mill heated at 100°–110° C., and melted and kneaded for 15 minutes. The kneaded product was removed. Then, the same kneading was repeated four times. The kneaded product was allowed to cool naturally, and roughly crushed by a cutter mill. Thus, a sample of 1 through 3 mm size was obtained. This sample is referred to as "Sample 2". Furthermore:

| | |
|---|---|
| Binder resin (the polyol resin: same as mentioned above): | 100 parts |
| Sample 2: | 20 parts |
| Charge controller (a quaternary ammonium salt containing fluorine): | 2 parts |

were treated in the same way as Example 1. Thereby, host colored particles of magenta color having an average particle diameter of 7.4 μm were obtained. Then, 0.5 parts of a similar titanium oxide fine powder were added to 100 parts of the host colored particles of magenta color mentioned above. Thus, a magenta color toner resulted. The haze factor of this toner was 7% and average dispersion diameter of the pigment in this toner was 0.18 μm.

This toner was evaluated in similar way to Example 1; whereby a clear magenta color image was obtained. The OHP projection image was of clear magenta color.

EXAMPLE 4

| | |
|---|---|
| Binder resin (polyol resin: same as Example 3); | 70 parts |
| Colorant (azo yellow pigment; C.I. Pigment Yellow 180): | 30 parts |

were kneaded in a three-roll mill in the same way as Example 3. A sample of 1 through 3 mm size was obtained. This sample is referred to as "Sample 3". Furthermore:

| | |
|---|---|
| Binder resin (polyol resin: same as Example 3): | 100 parts |
| Sample 3: | 15 parts |
| Charge controller (a quaternary ammonium salt containing fluorine): | 2 parts |

were treated in the same way as Example 1. A yellow color toner of an average particle diameter of 7.1 μm was obtained.

The haze factor of this toner was 7% and the average dispersion diameter of the pigment in this toner was 0.19 μm.

This toner was evaluated in the same way as Example 1; whereby a clear yellow color image was obtained. The OHP projection image was of clear yellow color.

EXAMPLE 5

A toner was prepared and the same evaluation was made in the same way as Example 4 except the charge controller used was a metal salt of salicylic acid derivative (Compound 1) and the average particle diameter of the toner was 8.1 μm.

The haze factor of this toner was 7% and the average dispersion diameter of the pigment in this toner was 0.20 μm.

A clear yellow color image was obtained. The OHP projection image was also clear.

EXAMPLE 6

A toner was prepared and the same evaluation was made in the same way as Example 3 except hydrophobic silica fine powder of 70% degree of hydrophobicity was used in place of the titanium oxide fine powder (average particle diameter of the toner: 7.4 μm).

The haze factor of this toner was 7% and average dispersion diameter of the pigment in this toner was 0.18 μm.

A clear magenta color image was obtained. The OHP projection image was also clear.

EXAMPLE 7

| | |
|---|---|
| Binder resin (polyester resin: same as Example 1): | 100 parts |
| Colorant (copper-Phthalocyanine Blue pigment) | 50 parts |
| Toluene | 15 parts |

were blended sufficiently by a blender. The blend was kneaded by a two-roll mill heated at 50° C. for 20 minutes. The kneaded product was allowed to cool, and roughly crushed by a cutter mill. A sample of 1 through 3 μm size was obtained. This sample is referred to as "Sample 4". Furthermore:

| | |
|---|---|
| Binder resin (same as Example 1): | 100 parts |
| Sample 4: | 4 parts |
| Charge controller (a metal salt of salicylic acid derivative: Compound 2) | 2 parts |

were blended sufficiently by a blender. The blend was charged into a two-roll mill heated at 100°–110° C., and melted and kneaded in the same way as Example 1 followed by similar additional treatment. A toner of an average particle diameter of 7.7 μm was obtained.

The haze factor of this toner was 4%. A clear cyano color image was obtained. The OHP projection image was also clear. The average dispersion diameter of the pigment in this toner was 0.12 μm.

EXAMPLE 8

| | |
|---|---|
| Binder resin (polyol resin same: as Example 2); | 50 parts |
| Colorant (azo yellow pigment: C.I. Pigment Yellow 180) | 50 parts |
| Acetone | 10 parts |

were treated in the same way as Example 7. Thereby, a sample of 1 through 3 mm size was obtained. This sample is referred to as "Sample 5". Furthermore:

| | |
|---|---|
| Binder resin (polyol resin: same as Example 2): | 100 parts |
| Sample 5: | 8 parts |
| Charge controller (a metal salt of salicylic acid derivative: Compound 3) | 2 parts |

were treated in the same way as Example 7. Thereby, a toner of an average particle diameter of 7.3 μm was obtained.

The haze factor of this toner was 3%. This toner provided a clear yellow color image. The OHP projection image was also clear. The average dispersion diameter of the pigment in this toner was 0.10 μm.

COMPARATIVE EXAMPLE 1

| | |
|---|---|
| Binder resin (polyester resin: same as Example 1): | 100 parts |
| Colorant (copper-Phthalocyanine Blue pigment): | 2 parts |
| Charge controller (a quaternary ammonium salt containing fluorine): | 2 parts |

were blended sufficiently by a blender. The blend was melted and kneaded by a two-roll mill heated at 100°–110° C. for 30 minutes. The kneaded product was allowed to cool naturally. Thereafter, the product was roughly crushed in a cutter mill, further crushed in a fine grinder using a jet air, and subjected to an air classifier. Thus, cyano colored host particles of a volume average diameter of 7.6 μm were obtained. By the same additional treatment as in Example 1, a cyano color toner was obtained.

The haze factor of this toner was 28% and the average dispersion diameter of the pigment in this toner was 0.51 μm.

The image produced by this toner was evaluated in the same way as Example 1. While an image of cyano color was obtained, the projection image using an OHP sheet was unable to be distinguished. In addition, after printing 30,000 sheets, pigment contamination of the cyano color was observed on the developing roller and fog appeared on the texture of image.

COMPARATIVE EXAMPLE 2

| | |
|---|---|
| Binder resin (polyol resin: same as Example 3): | 80 parts |
| Colorant (quinacridone magenta pigment): | 20 parts |

were blended sufficiently by a blender. The blend was charged into a three-roll mill heated at 100°–110° C., and melted and kneaded for 15 minutes. The kneaded product was removed. The kneaded product was allowed to cool naturally, and roughly crushed by a cutter mill. Thus, a sample of 1 through 3 μm size was obtained. This sample is referred to as "Sample 6". Furthermore:

| | |
|---|---|
| Binder resin (polyol resin: same as Example 3): | 100 parts |
| Sample 6: | 20 parts |
| Charge controller (a quaternary ammonium salt containing fluorine): | 2 parts |

were treated in the same way as Example 1. Thereby, a magenta color having an average particle diameter of 7.8 μm was obtained.

The haze factor of this toner was 18% and the average dispersion diameter of the pigment in this toner was 0.38 μm.

The image produced by this toner was evaluated in the same way as Example 1. While an image of magenta color was obtained, the projection image using an OHP sheet could barely be discerned. In addition, after printing 30,000 sheets, thin pigment contamination of the magenta color was observed on the developing roller and some fouling appeared on the texture of the image.

COMPARATIVE EXAMPLE 3

| | |
|---|---|
| Binder resin (polyester resin: same as Example 1): | 70 parts |
| Colorant (quinacridone magenta pigment) | 30 parts |

were blended sufficiently by a blender. The blend was charged into a three-roll mill heated to 100°–110° C., and melted and kneaded for 15 minutes. The kneaded product was removed. The kneaded product was allowed to cool naturally and roughly crushed thereafter by a cutter mill to get a sample of 1 through 3 μm size. This sample is referred to as "Sample 7". Furthermore;

| | |
|---|---|
| Binder resin (the polyester resin: same as Example 1): | 100 parts |
| Sample 7: | 14 parts |
| Charge controller (a quaternary ammonium salt containing fluorine): | 2 parts |

were blended sufficiently by a blender and subjected to the same treatment as Example 3. Thereby, a toner of magenta color having an average particle diameter of 7.4 μm was obtained.

The haze factor of this toner was 13%. The average dispersed pigment diameter of this toner was 0.26 μm.

The image of this toner was evaluated in the same way as Example 1. While an image of magenta color was obtained, the projection image using an OHP sheet gave discernible, but unclear magenta color. In addition after printing 30,000 sheets, thin pigment contamination of the magenta color was observed on the developing roller and some fouling appeared on the texture of image.

Tables 2 and 3 summarize the characteristics and evaluation results of the toners described above. The evaluation criteria for projected images by OHP are as follows.

TABLE 2

| | Toner Characteristics | | |
|---|---|---|---|
| | Haze-Degree (%) | Average Dispersed Pigment Diameter of the Toner (μm) | Quality Evaluation Projected Image by OHP (Rank) |
| Ex. 1 | 10 | 0.25 | 4 |
| Ex. 2 | 10 | 0.24 | 4 |
| Ex. 3 | 7 | 0.18 | 4.5 |
| Ex. 4 | 7 | 0.19 | 4.5 |
| EX. 5 | 7 | 0.20 | 4.5 |
| Ex. 6 | 7 | 0.18 | 4.5 |
| Ex. 7 | 4 | 0.12 | 5 |
| Ex. 8 | 3 | 0.10 | 5 |
| C. Ex. 1 | 28 | 0.51 | 1 |
| C. Ex. 2 | 18 | 0.38 | 2 |
| C. Ex. 3 | 13 | 0.26 | 3 |

Ex.: Example
C. Ex.: Comparative Example
Rank 5: Clear color development
Rank 4: Enough color development but the clearness is insufficient
Rank 3: Discernible color but unclear
Rank 2: Barely discernible color
Rank 1: No discernibie color

TABLE 3

| | Quality Evaluation | | | |
|---|---|---|---|---|
| | Electrostatic Charge of Toner on Developing Roller (−μC/g) | | Toner Contamination on Developing Roller | Fog on Texture |
| | Initial (%) | After Printing 30,000 Sheets | After Printing 30,000 Sheets | After Printing 30,000 Sheets |
| Ex. 1 | 10 | 10 | No | No |
| Ex. 2 | 10 | 10 | No | No |
| Ex. 3 | 7 | 7 | No | No |
| Ex. 4 | 7 | 7 | No | No |
| Ex. 5 | 7 | 7 | No | No |
| Ex. 6 | 7 | 7 | No | No |
| Ex. 7 | 4 | 4 | No | No |

TABLE 3-continued

| | Quality Evaluation | | | |
|---|---|---|---|---|
| | Electrostatic Charge of Toner on Developing Roller (−μC/g) | | Toner Contamination on Developing Roller | Fog on Texture |
| | Initial (%) | After Printing 30,000 Sheets | After Printing 30,000 Sheets | After Printing 30,000 Sheets |
| Ex. 8 | 3 | 3 | No | No |
| C. Ex. 1 | 28 | 28 | Yes | Yes |
| C. Ex. 2 | 18 | 18 | Some | Some |
| C. Ex. 3 | 13 | 13 | Some | Some |

The dry color toner for electrophotography according to the invention gives a haze factor of not more than 15% at least in a toner mainly comprising a binder resin, pigment and charge controller. Thus, this toner provides clear color development in projection images by an OHP.

The dry color toner for electrophotography preferably has the average dispersed pigment diameter not more than 0.2 μm. Hence, this toner provides clear color development of projection images by an OHP, and prevents peeling off of the pigment from the toner surface; thereby contamination of the developing roller decreases and the chargeability is stabilized.

The dry color toner for electrophotography also preferably contains C.I. Pigment Yellow 180 in particular as the pigment. Hence, contamination of the developing roller due to a long period of service decreases and the chargeability is stabilized.

The dry color toner for electrophotography also preferably contains a metal salt of a salicylic acid derivative as the charge controller. Hence, the charge of the toner on the developing roller with the elapse of time is further stabilized, and this toner provides high quality color images stably for a long period.

The dry color toner for electrophotography preferably contains hydrophobic silica fine powder, as an external additive, which has a degree of hydrophobicity of not less than 50%. Hence, the charge of the toner on the developing roller is stabilized for a long period.

The novel process for producing dry color toner for electrophotography of the invention includes a preliminary kneading of a blend of a binder resin and pigment with an organic solvent at a temperature lower than melting temperature of the binder resin. Hence, according to this process, the pigment in the toner is dispersed effectively. This process produces a toner that provides excellent color development of projection images by an OHP, and prevents peeling off of the pigment from the toner surface.

The process for producing a dry color toner for electrophotography preferably includes a first step kneading under conditions where 5 through 20 parts by weight of the organic solvent are used. This is added preliminarily to the kneaded product to 100 parts of the (binder resin+pigment). Hence, according to this process, the pigment dispersion in the toner is made more effectively. The dry color toner and process for the present invention can be used with any conventional binder resin known for use in preparing color toners. Suitable binders include polyester and polyol binder resins although the invention is in no way limited to these specific resins. One having ordinary skill in this art can readily determine suitable binder resins for use in the invention.

Obviously, numerous modifications and variations of the present invention are possible in light of the above teachings. It is therefore to be understood that, within the scope of the appended claims, the invention may be practiced otherwise than as specifically described herein.

What is claimed as new and is desired to be secured by Letters Patent of the United States is:

1. A dry color toner for electrophotography comprising a binder resin, a pigment dispersed in said binder resin and a charge controller, wherein said color toner has a haze factor of 1% through 10%, and said pigment has an average dispersed diameter of not more than 0.2 μm.

2. The dry color toner for electrophotography of claim 1, wherein said pigment comprises C.I. Pigment Yellow 180.

3. The dry color toner for electrophotography of claim 1, wherein said charge controller comprises a metal salt of a salicylic acid compound.

4. The dry color toner for electrophotography of claim 1, wherein said dry color toner comprises hydrophobic silica fine powder having a degree of hydrophobicity of not less than 50%.

5. A process for producing the dry color toner for electrophotography of claim 1, comprising the steps of:

first kneading a blend of said binder resin and said pigment with an organic solvent at a temperature lower than the melting temperature of said binder resin;

adding said kneaded binder resin and pigment and said charge controller to form a mixture and subjecting said mixture to thermal melting and kneading.

6. The process of claim 5, wherein 5 through 20 parts by weight of said organic solvent are added to 100 parts by weight of binder resin plus pigment.

7. The dry color toner for electrophotography of claim 3, wherein said metal salt of a salicylic acid is present in an amount of 0.5–8% by weight.

8. The dry color toner for electrophotography of claim 4, wherein said hydrophobic silica fine powder is present in an amount of 0.1–2% by weight.

9. The dry color toner for electrophotography of claim 8, wherein said hydrophobic silica fine powder is present in an amount of 0.5–1% by weight.

10. The dry color toner for electrophotography of claim 1, prepared by a process comprising the steps of:

first kneading a blend of said binder resin and said pigment with an organic solvent at a temperature lower than the melting temperature of said binder resin;

adding said kneaded binder resin and pigment and said charge controller to form a mixture; and subjecting said mixture to thermal melting and kneading.

11. The dry color toner for electrophotography of claim 10, wherein 5–20 parts by weight of said organic solvent are added to 100 parts by weight of binder resin plus pigment.

12. The dry color toner for electrophotography of claim 10, wherein said organic solvent is selected from the group consisting of acetone, toluene and methyl ethyl ketone.

13. The dry color toner for electrophotography of claim 11, wherein said charge controller comprises a metal salt of a salicylic acid in an amount of 0.5–8% by weight.

14. The dry color toner for electrophotography of claim 11, further comprising 0.1–2% by weight hydrophobic silica fine powder having a degree of hydrophobicity of not less than 50%.

15. The process of claim 6, wherein said organic solvent is selected from the group consisting of acetone, toluene and methyl ethyl ketone.

* * * * *